US006192099B1

(12) United States Patent
Chiu

(10) Patent No.: US 6,192,099 B1
(45) Date of Patent: Feb. 20, 2001

(54) RACE-TRACK LAP COUNTER

(75) Inventor: Andrew Shun Pui Chiu, Kowloon (HK)

(73) Assignees: Ngai Keung Metal & Plastic Manufactory Limited (HK); Ta Spiel & Freizeit Holding GmbH (DE)

( * ) Notice: Under 35 U.S.C. 154(b), the term of this patent shall be extended for 0 days.

(21) Appl. No.: 09/239,954

(22) Filed: Jan. 29, 1999

(51) Int. Cl.[7] ..... A63B 71/06
(52) U.S. Cl. ..... 377/5; 463/59
(58) Field of Search ..... 463/58–60; 377/5

(56) References Cited

U.S. PATENT DOCUMENTS 4,997,187 * 3/1991 Smollar et al. ..... 273/86 B
5,299,969 * 4/1994 Zaruba ..... 446/429
5,542,668 * 8/1996 Casale et al. ..... 463/59
5,676,586 * 10/1997 James ..... 446/444

* cited by examiner

*Primary Examiner*—Margaret R. Wambach
(74) *Attorney, Agent, or Firm*—Burns, Doane, Swecker & Mathis, L.L.P.

(57) ABSTRACT

A lap counting mechanism is described for a race-track for toy cars of the type in which the cars are guided in slots. The guide member of the car, which in use is received within the slots, is provided with a left-right asymmetry and the lap counting mechanism is able to detect this asymmetry. This allows at least two cars to be clearly distinguished by the lap counting mechanism and so the number of laps that an individual car has done may be totaled accurately even though the cars may swap tracks and slots. The sensing means and the associated asymmetry may be electrical, optical or magnetic. Means are also provided for detecting the speed of the cars and for generating sound and light effects.

9 Claims, 5 Drawing Sheets

RACE-TRACK LAP COUNTER

FIELD OF THE INVENTION

This invention relates to a lap counter for a race track for toy racing cars or the like, and in particular to a lap counter able to take into account the possibility of cars crossing from one track to another.

BACKGROUND OF THE INVENTION

Race-tracks for toy cars and the like are a very popular form of toy. A particularly popular form of such toy is one where the race track is formed from a plurality of segments that can be fitted together to form a race track of any desired shape, and where the cars are guided and powered by means of a slot formed along the track segments and thus along the completed track when the segments are put together.

Generally such race tracks include two parallel slots per segment, and thus the completed race track includes two parallel guide slots. Since of course the race track is normally configured so as to form a closed loop, one of these slots will be an inner slot and the other will be an outer slot. Inevitably therefore the distance taken by one slot in a complete lap will be shorter than the distance taken by the other, and since compared to a real race track such a toy race track has proportionately tighter bends, this difference is significant and a toy racing car in the outer slot will have to travel a substantially longer distance than one in the inner slot.

To overcome this disparity in distance of the two slots, it is conventional to have one track segment in which the two slots cross over. If such a segment is included in the completed race track then the effect is that once every lap the two tot racing cars will swap slots. The toy car in the outer slot will move to the inner, and the toy car in the inner slot will move to the outer. Over a number of laps this will even out the disparity that would otherwise be caused by the difference in length between the inner and outer slots.

PRIOR ART

One disadvantage of the introduction of a cross-over segment into the track, however, is that it makes lap counters approximate. A popular feature of such toy racing tracks is that means are provided to count the number of laps completed by the toy cars. Generally such means include means located in each slot for noting when a car passes, and for totaling this number and displaying it so as to be seen by a user. However, when the cars are swapping tracks on a regular basis since the lap counters only recognise that a car has passed by and do not know which car has passed the counter, the lap counter can only be approximate and one cannot tell with certainty exactly how many laps each individual car has completed.

SUMMARY OF THE INVENTION

According to the present invention therefore there is provided a lap counting mechanism for a toy race car adapted to be guided in a slot formed in a race track, wherein the race car is formed with a guide member that travels in the slot, the guide member being formed with a left-right asymmetry, and wherein the track is provided with means for sensing the presence of a car and for identifying the car sensed by means of the left-right asymmetry.

By means of this arrangement it is possible for the lap counting mechanism not only to detect that a car has passed but to be able to know which car has passed. The laps done by individual cars may therefore be counted accurately even though the cars may be changing tracks.

The asymmetry may be formed by providing one side of the guide member with means responded to by the sensing means. The asymmetry and the sensing means may be of an electrical nature, or an optical nature or a magnetic nature.

For example, in one embodiment one side of the guide member is formed with a conductive surface and the sensing means comprise pairs of electrical contacts formed on either side of the slot, the pair of contacts on the side of the slot corresponding to the conductive surface being electrically connected by the conductive surface as the car passes the sensing means.

Alternatively in another embodiment one side of the guide member is formed with a reflective surface and the sensing means comprise optical sensors formed on either side of the slot, the sensors comprising a light emitting means and a light receiving means, and the optical sensor on the side of the slot corresponding to the reflective surface generating a signal as a car passes the sensing means by light emitted from the light emitting means being reflected from the reflective surface to the light receiving means.

In addition to a simple left-right asymmetry, the means that is responded to by the sensing means may also encode more complex information. This may be achieved for example by dividing the means responded to into segments along the guide member. This information may be used to further identify the car, or it may be used to help calculate the speed.

It may also be possible to use the detection of a passing car to trigger the generation of sound and/or light effects.

It will also be understood that while the invention is particularly suitable for use with toy racing cars, it is not limited thereto and may be applied to any form of toy race track where the items being raced are guided by slots. For example toy trains, boats, horses etc. The invention should not therefore be considered limited to toy racing cars.

BRIEF DESCRIPTION OF THE DRAWINGS

An embodiment of the invention will now be described by way of example and with reference to the accompanying drawings, in which.

DETAILED DESCRIPTION OF PREFERRED EMBODIMENTS

Figure 1:
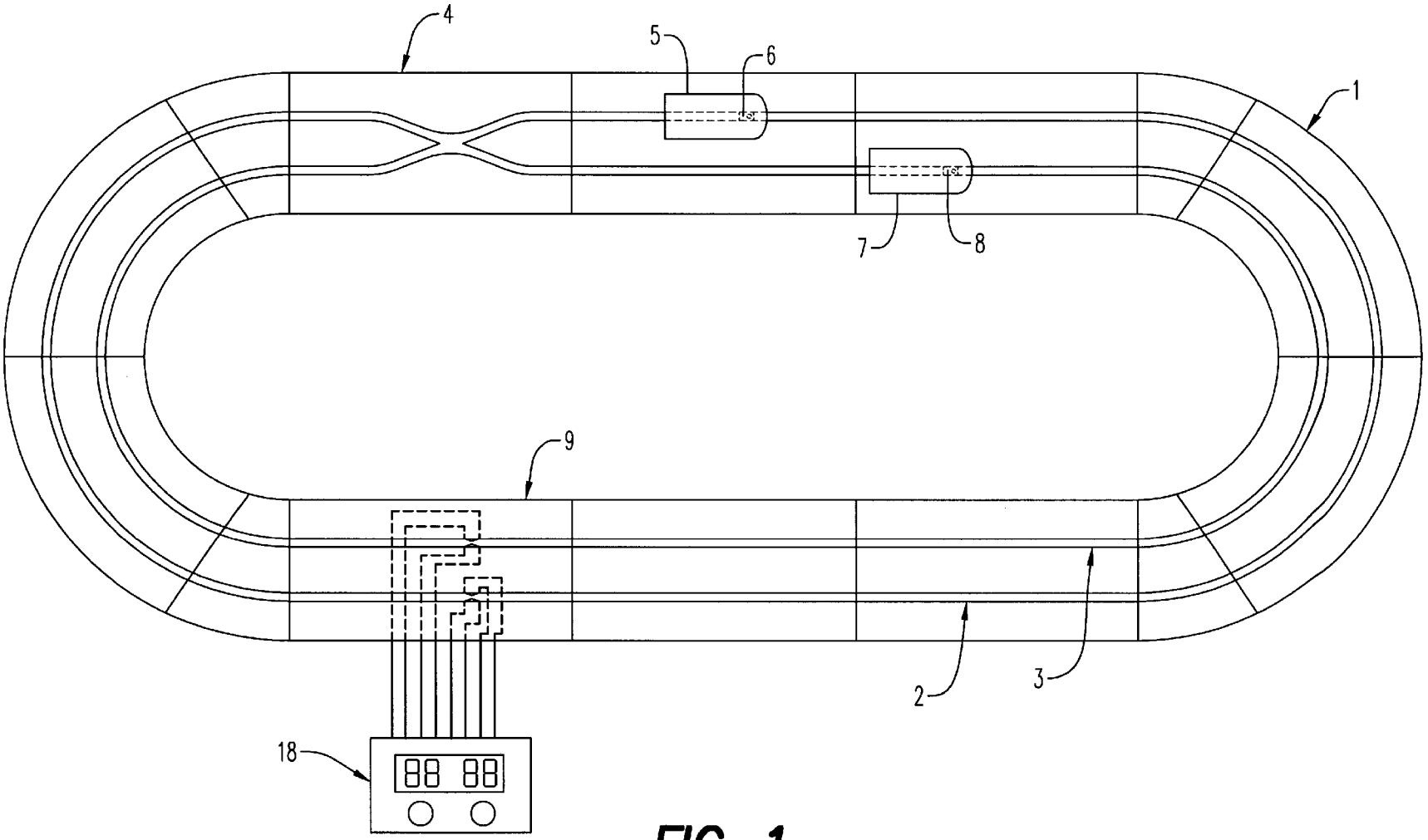
FIG. 1 is a plan view of a toy race track including a lap counter in accordance with an embodiment of the present invention.

Referring firstly to FIG. 1 there is shown a race track for toy racing cars in the form of an oval formed of multiple interlocking track segments 1. As is conventional the track segments 1 may include a mixture of straight track segments and curved track segments which may be interconnected to form any desired track configuration.

As is also conventional each track segment 1 comprises two parallel guide slots 2,3 such that when the track segments are connected together two continuous guide slots are formed extending about the complete oval track. Two toy racing cars 5,7 are provided each with a guide member 6,8 adapted to be received within the guide slots 2,3. The guide members 6,8 within the guide slots 2,3 serve both to guide the toy cars 5,7 about the track, and also normally serve as a power pick-up means unless the cars are provided with their own power source (eg a battery).

The two tracks 2,3 comprise an outer track 2 and an inner track 3. Because of the fact that compared to the dimensions of the cars the track is in fact a very short and tight track, the inner track 3 is significantly shorter than the outer track 2. As can be seen from FIG. 1 one track segment 4 is a cross-over segment in which the two tracks 2,3 cross-over so that the a car which is running along the outer track 2 moves to the inner track 3, and vice versa, to ensure fairness in the distance that the two cars travel over a number of laps.

As can also be seen in FIG. 1, the race track also includes a lap counter segment 9 provided with means connected with each track 2,3 to count the number of times that the cars pass this slot and thus keep count of the number of laps of the track done by each car. This counting means will now be described in more detail with reference to FIGS. 2 and 3.

Figure 2:
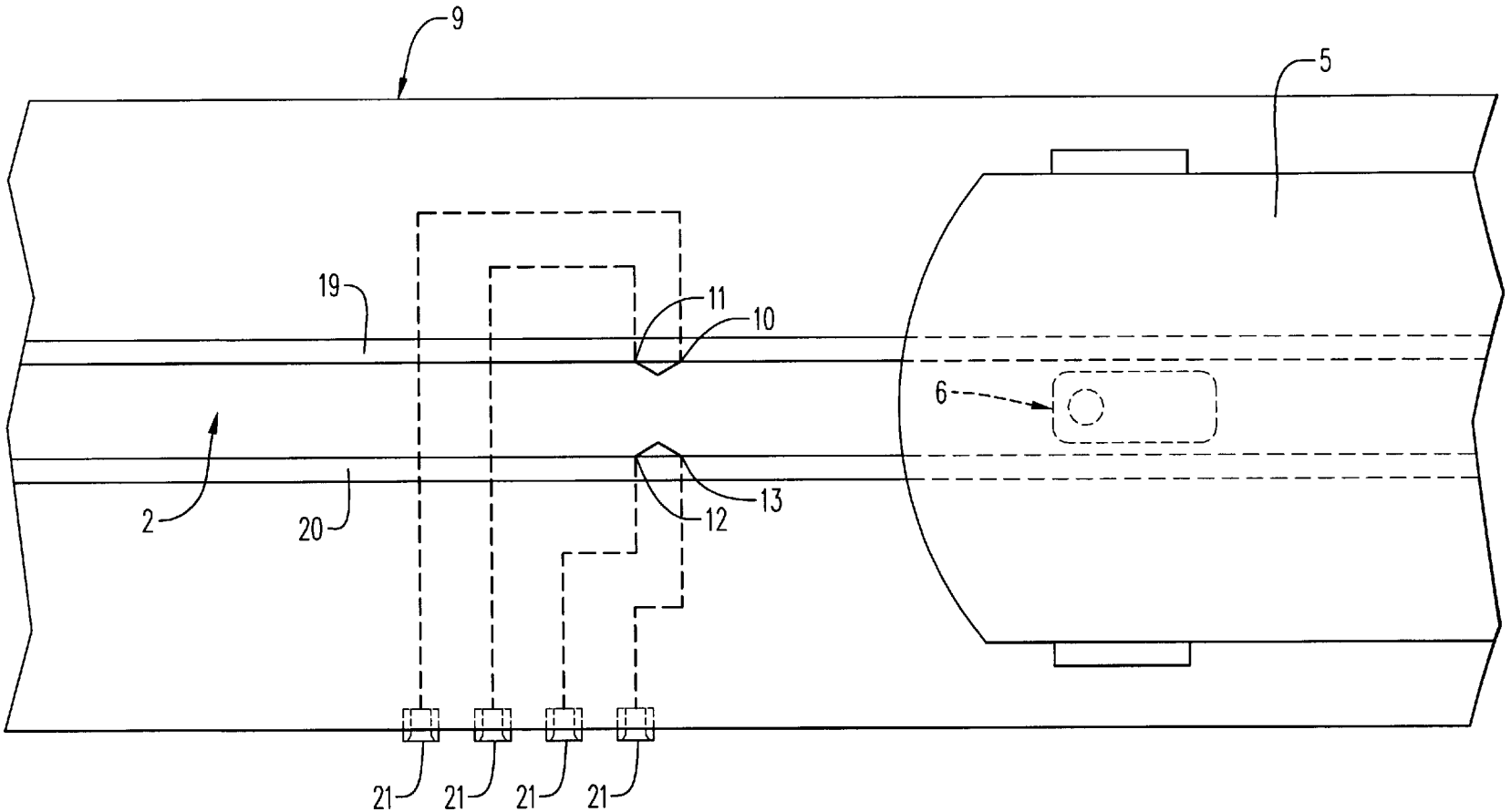
FIG. 2 is a plan view in detail showing a section of track having a lap counter mechanism in accordance with an embodiment of the invention.

FIG. 2 shows a portion of the lap counting segment 9 in plan view with car 5 moving towards the counting means and being guided in slot 2 by guide member 6. The lap counting means comprises pairs of electrical contacts 10,11 and 12,13 disposed on either side of the guide slot 2 and projecting into the guide slot 2 away from the respective side walls 19,20 of the guide slot 2. Each electrical contact 10–13 is connected to a respective socket 21 from which in turn cabling may lead to suitable digital counting means 18 (FIG. 2). As can be seen from FIG. 3 the contacts within each pair are located at different heights and are not normally in contact with each other.

Figure 4:
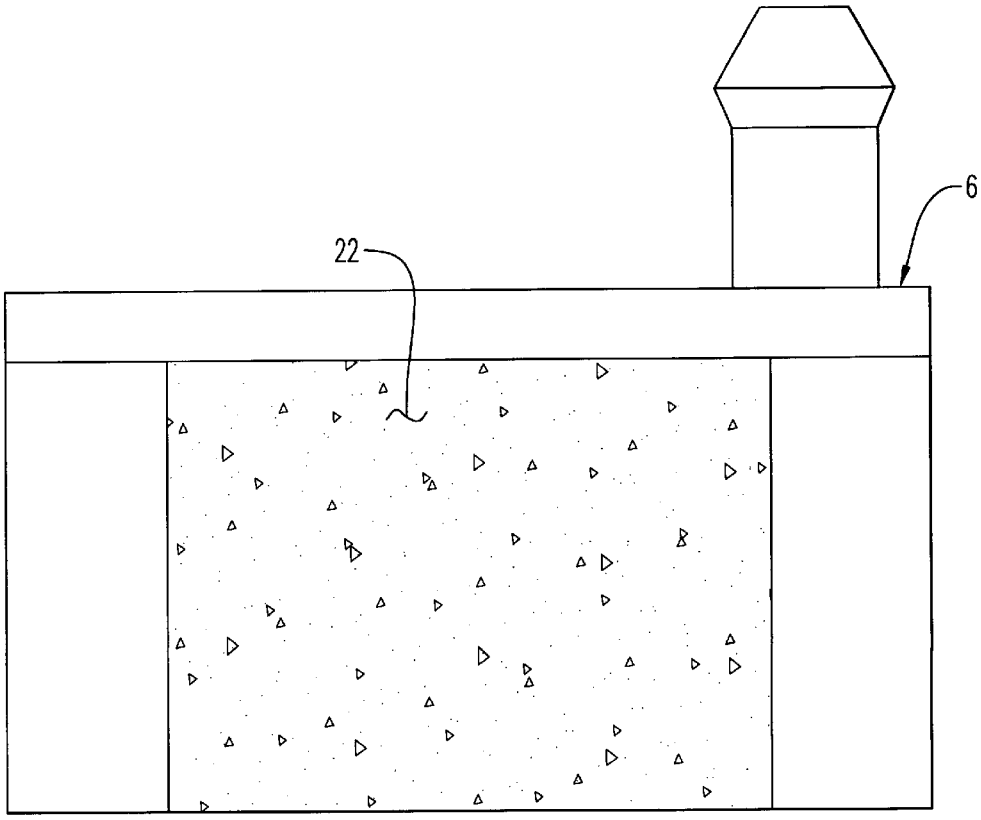
FIG. 4 is a side view of a slot following member of a toy racing car in accordance with an embodiment of the invention.

As can be seen from FIG. 4, the guide member 6 comprises a generally planar rectangular member one side only of which is formed of a conductive material 22. Thus as the car 5 moves through the lap counting means the guide member 6 will contact the pairs of electrical contacts 10,11 and 12,13 and on the side of the guide member formed with a conductive material 22 the contacts will be briefly electrically connected and a circuit closed allowing the counting means 18 to increment by one. The two cars—which would otherwise be substantially identical—will differ in that they will have a left-right asymmetry in the guide member. That is to say, one car 5 will be provided with the conductive material on the left side (as viewed in the normal direction of motion of the car) of the guide member 6, while the other car 7 will have the conductive material 22 provided on the right side of the guide member 8.

Figure 3:
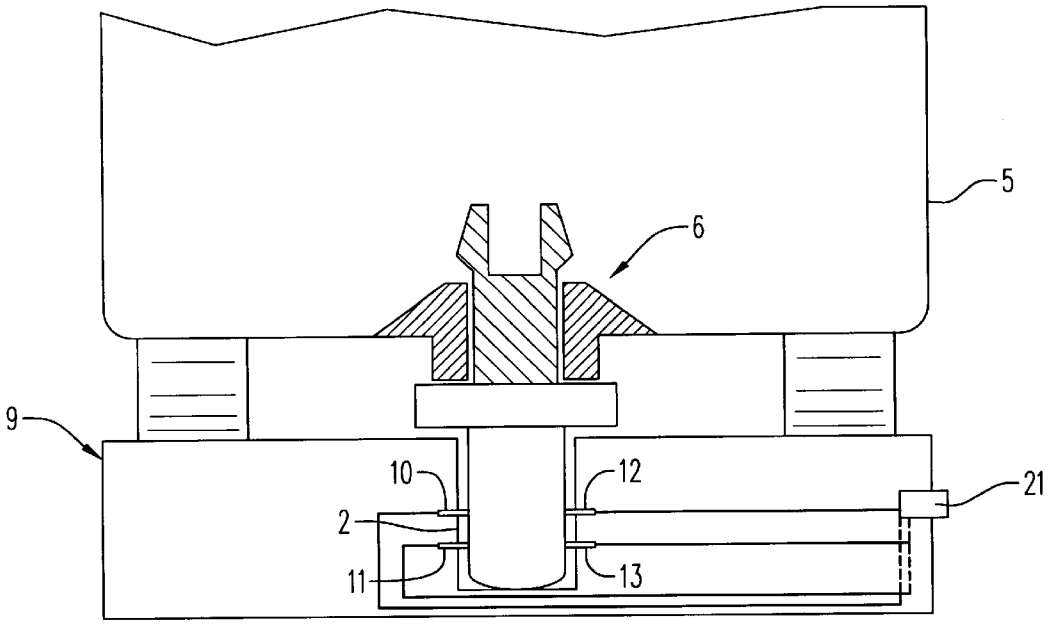
FIG. 3 is a sectional view through a track segment with a toy racing car thereon.

Thus the lap counting means is able to differentiate between the two cars. As car 5 passes through the lap counting means contacts 12,13 will be briefly connected, while when car 7 passes through the lap counting means contacts 10,11 will be connected. Thus the lap counting means is able to tell which car has passed through the lap counting means and can accurately keep track of the number of laps completed by the individual cars regardless of the fact that the cars are continuously interchanging tracks and that if one car is well ahead of the other it is quite possible that at some stage both cars may be running in the same track. It will of course be appreciated that lap counting means as shown in FIGS. 2 and 3 are provided in both tracks 2 and 3. Track 3 is provided with corresponding pairs of contacts 14,15 and 16,17 as shown in FIG. 1.

Figure 5:
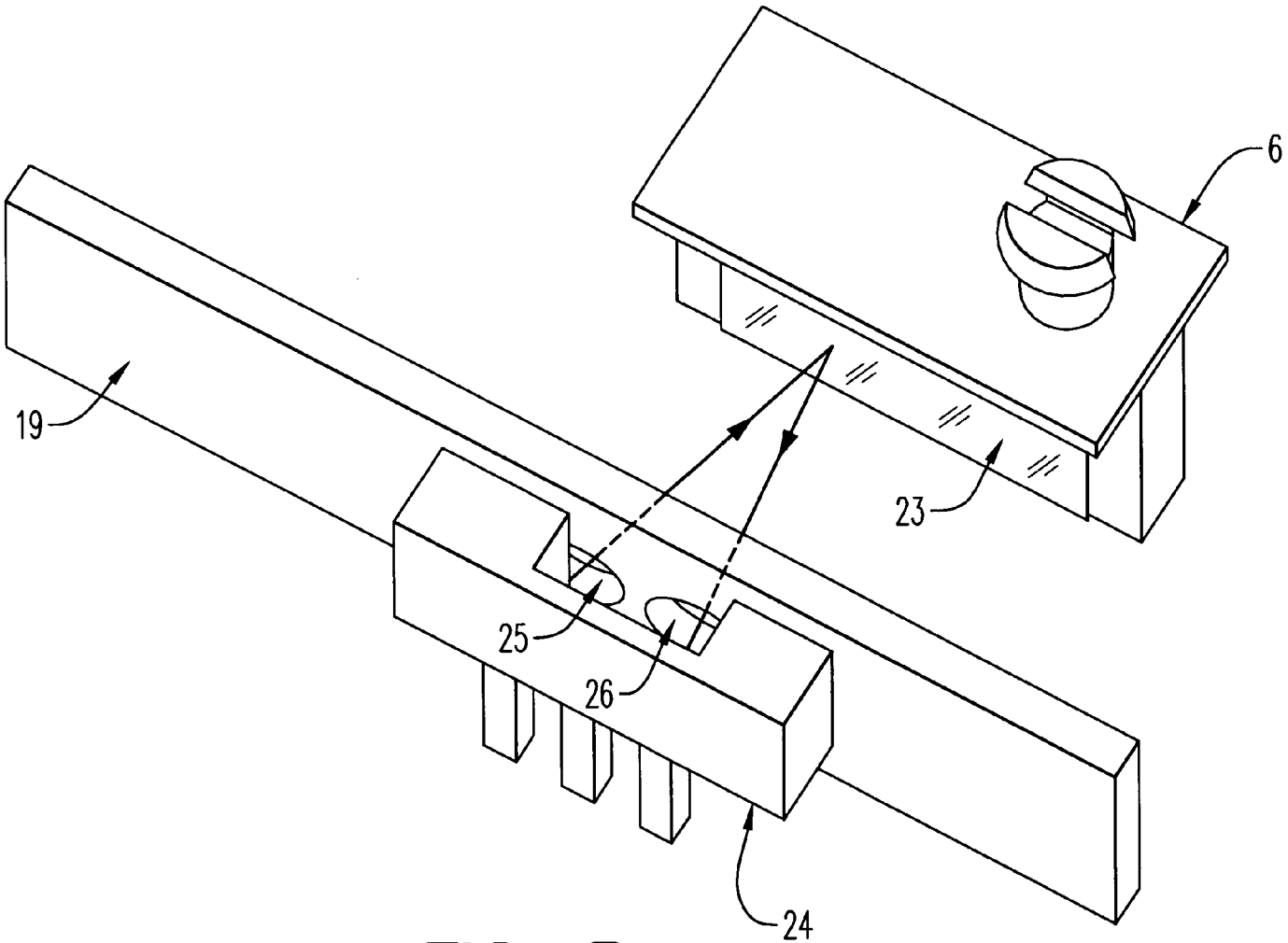
FIG. 5 is a perspective view of a lap counter according to another embodiment of the invention.

The pairs of electrical contacts of the embodiment of FIGS. 1 to 4 are not the only way that the present invention could be implemented. For example instead of providing the guide member 6 with an electrical left-right asymmetry by providing a conducting material on one side, there may instead be an optical symmetry by providing one side of the guide member 6 with a reflective surface 23. In this possible arrangement the lap counting means may comprise an optical sensor fixed to each side 19,20 of the guide slot 6. As shown in FIG. 5 the optical sensor 24 may comprise a light emitting means 25, such as a light emitting diode, and a light sensor 26 which detects returned light reflected from the reflective surface to generate a lap counter incrementing signal. Again in this embodiment the lap counting means is able to distinguish between the two cars 5,7 based on a left-right asymmetry, in this case which side of the guide member 6 bears the reflective surface. Similarly the asymmetry could be of a magnetic nature and could therefore be detected by magnetic sensors provided on either side of the guide slot 6.

Figure 6:
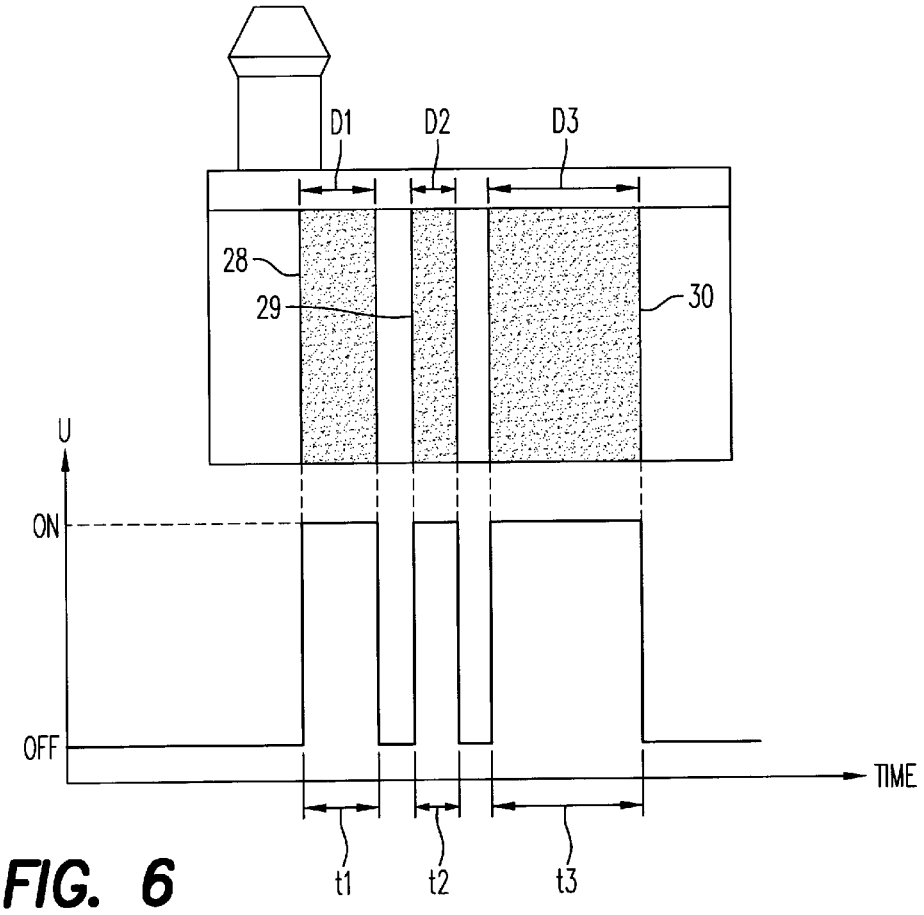
FIG. 6 is a side view of a slot following member of a toy racing car in accordance with a further embodiment of the invention.

As shown in FIG. 6 be the asymmetry electrical, optical or magnetic it can be used to provide more information than simply differentiating between two cars on a left-right asymmetry basis. For example the side of the guide member 6 provided with either an electrically conductive, optically reflective or magnetically responsive surface could be divided into segments 28,29,30 of such a surface and of varying length to provide a code. As the car 5 bearing the guide member 6 passes through the lap counting mechanism a pulsed signal will be generated with pulses of lengths t1, t2 and t3 depending on the lengths of the segments 28,29,30. This ability to encode information on the guide member 6 may be used for a number of purposes, for example it may allow the lap counting mechanism to distinguish between more than two cars if three or more cars are raced on the same race track. In addition since the absolute values of t1, t2 and t3 will depend on the speed of the car, the speed can be calculated and displayed if desired along with the lap count.

Figure 7:
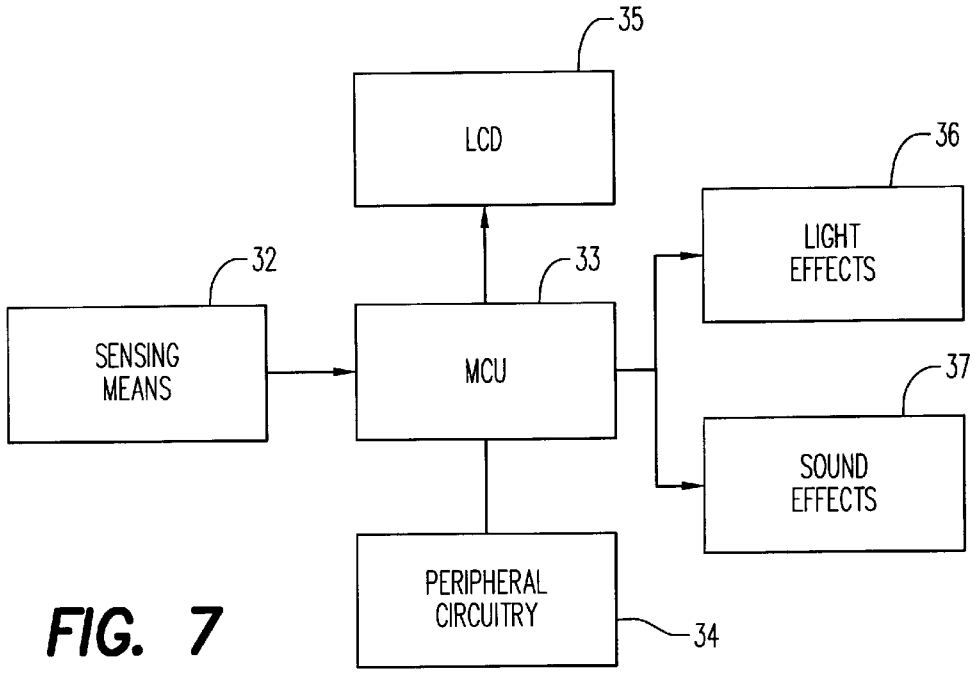
FIG. 7 is a block diagram showing the function of the lap counter in conjunction with other elements of a toy car racing track.

FIG. 7 shows schematically in block diagram form how the information concerning a passing car can be used. A sensor input signal 32 is received from the car sensing means be it electrical, optical, magnetic or any other form. This signal is processed by a central processor micro-computing unit (MCU) 33 and peripheral circuitry 34 to identify which car has passed and any other desired information such as speed of the car which may then be displayed with the lap count on LCD display 35. In addition the detected presence of the car may be used to generate any desired sound or light effects from light generating means 36 and sound generating means 37. Since the cars can be identified different effect may be generated for each car.

What is claimed is:

1. A lap counting mechanism for a toy race car adapted to be guided in a slot formed in a race track, wherein said race car is formed with a guide member that travels in said slot, said guide member being formed with a left-right asymmetry, and wherein said track is provided with means for sensing the presence of a car and for identifying the car sensed by means of said left-right asymmetry.

2. A lap counting mechanism as claimed in claim 1 wherein said asymmetry is formed by providing one side of said guide member with means responded to by said sensing means.

3. A lap counting mechanism as claimed in claim 2 wherein one side of said guide member is formed with a conductive surface and wherein said sensing means comprise pairs of electrical contacts formed on either side of said slot, the pair of said contacts on the side of the slot corresponding to said conductive surface being electrically connected by said conductive surface as said car passes said sensing means.

4. A lap counting mechanism as claimed in claim 2 wherein one side of said guide member is formed with a reflective surface and wherein said sensing means comprise optical sensors formed on either side of said slot, the sensors comprising a light emitting means and a light receiving means, and the optical sensor on the side of the slot corresponding to said reflective surface generating a signal as said car passes said sensing means by light emitted from said light emitting means being reflected from said reflective surface to said light receiving means.

5. A lap counting mechanism as claimed in claim 2 wherein said means responded to by said sensing means encodes information relating to said car.

6. A lap counting mechanism as claimed in claim 5 wherein said information is encoded by dividing said means responded to into segments along the guide member.

7. A lap counting mechanism as claimed in claim 1 further comprising means for detecting the speed of a car.

8. A lap counting mechanism as claimed in claim 1 further comprising means for generating sound and/or light effects when a car passes said sensing means.

9. A lap counting mechanism as claimed in claim 1 wherein said asymmetry and said sensing means are electrical, optical or magnetic.

* * * * *